US006497502B1

(12) United States Patent
Clift et al.

(10) Patent No.: US 6,497,502 B1
(45) Date of Patent: Dec. 24, 2002

(54) ELECTRICAL CANDLESTICK DEVICE

(76) Inventors: Joe F. Clift, 10003 Altamont Cir., Fredericksburg, VA (US) 22408; Ruth L. Ernst, 9909 Altamont Cir., Fredericksburg, VA (US) 22408

( * ) Notice: Subject to any disclaimer, the term of this patent is extended or adjusted under 35 U.S.C. 154(b) by 0 days.

(21) Appl. No.: 09/880,845

(22) Filed: Jun. 15, 2001

(51) Int. Cl.[7] ..... F21V 35/00
(52) U.S. Cl. ..... 362/392; 362/396; 362/810
(58) Field of Search ..... 362/392, 396, 362/810; 248/208

(56) References Cited

U.S. PATENT DOCUMENTS 4,392,191 A * 7/1983 White, Sr. ..... 362/392
4,468,721 A * 8/1984 Vandrilla ..... 362/392
5,199,781 A * 4/1993 Sweeny ..... 362/145
5,829,869 A * 11/1998 Clegg et al. ..... 362/392
D403,440 S * 12/1998 Holmes et al. ..... D26/9

* cited by examiner

*Primary Examiner*—Thomas M. Sember
(74) *Attorney, Agent, or Firm*—William L. Klima

(57) ABSTRACT

An electrical candlestick device including a candlestick portion and base portion provided with a mounting extension configured to be captured between a movable sash and stationary window sill. In preferred embodiments, the mounting portion accommodates a power cord for outdoor applications and includes a finger/thumb grip to facilitate installation and removal thereof.

19 Claims, 6 Drawing Sheets

ELECTRICAL CANDLESTICK DEVICE

FIELD OF THE INVENTION

The present invention is directed to an electrical candlestick device. More specifically, the present invention is directed to an electrical candlestick device for lighting and/or decorating a window of a residence and/or commercial building.

BACKGROUND OF THE INVENTION

There currently exists electrical candlesticks including a lightbulb and standard electrical cord and plug for connection with an UL (Underwriters Laboratories) outlet. Typically, these electrical type candles are rated for indoor use only by Underwriters Laboratories (UL) in the United States. These electrical candles include a plastic base connected to a plastic candlestick provided with an electrical socket for a conventional lightbulb having a threaded type electrical connector base. A length of standard two (2) wire electrical cord extends through the base and candlestick portion to connect with the electrical socket at one end and provided with a standard UL plug at an opposite end thereof.

These conventional electrical candles are typically supported by an inner ledge or interior sill of a double hung window having movable upper and lower sashes. In the event the window is of such a construction so as not to provide a sufficient size interior sill for these conventional electrical candles, there exists a number of devices for connecting the conventional electrical candle to this type of window. For example, a suction cup device with a mechanical connector is available for mechanically securing the electrical candle to the glass of the lower sash. Alternatively, the conventional electrical candle can be potentially taped (e.g. double sided foam adhesive tape such as made by 3M Corporation of Minneapolis, Minn.) or using strapping tape for taping the electrical candle to the window, sill and/or sash. Other makeshift types of connection of a conventional electrical candle to a conventional double hung window are known.

There exists other disadvantages of using a conventional indoor electrical candle in that the glass pane significantly reflects a portion of the light being emitted from the conventional electrical candle, thus reducing the brightness when viewed from the exterior of the residence and/or building. Further, if the glass pane is not cleaned both inside and outside, the dirt on the window again reduces the amount of light emitting from the conventional electrical candlestick. In addition, conventional indoor electrical candles not properly fastened or mounted can be a fire and safety hazard, if the candle becomes inadvertently disconnected and falls onto the curtains or carpet with a hot electrical light bulb in contact therewith. Thus, there exists a need for a more safe, bright and decorative electrical candle device in view of the difficulties of the prior art devices.

SUMMARY OF THE INVENTION

A first object of the present invention is to provide an improved electrical candle device.

A second object of the present invention is to provide an improved outdoor electrical candle device.

A third object of the present invention is to provide an electrical candle device configured to fit or be captured between a movable sash and stationary sill of a window.

A fourth object of the present invention is to provide an electrical candle device configured to fit between a movable sash and stationary sill of a window when the window is in a closed position.

A fifth object of the present invention is to provide an electrical candle device having a base portion provided with a mounting extension configured to fit between a movable sash and stationary sill of a window.

A sixth object of the present invention is to provide an electrical candle device having a base provided with a mounting extension configured to fit between a movable sash and stationary sill of a window, the extension containing a wire conductor connecting a light emitting device, such as a lightbulb, with a power source.

The present invention is directed to an electrical candle device, preferably an outdoor electrical candle device. However, some features and embodiments of the present invention besides for outdoor applications only can be used for indoor and outdoor/indoor applications.

The electrical candle device according to the present invention is configured to be mounted on the sill of a window that can be opened and closed (e.g. double hung type window with movable upper sash and movable lower sash). Specifically, the electrical candle device according to the present invention includes a candlestick portion and a base portion configured to cooperate with the window sill in a manner to support the candlestick in a substantially vertical position adjacent and substantially parallel with the window (e.g. sash or glass). The base portion of the electrical candle device according to the present invention, for example, can be shaped to follow the cross-sectional profile of the sill of the window so that the candlestick portion is substantially vertically positioned. More specifically, a lower surface of the base portion of the electrical candle device according to the present invention can be configured and/or shaped to follow the cross-sectional profile of the window sill.

The base portion of the electrical candle device according to the present invention can be free standing on the window sill and/or can be connected in various ways to the window sill (e.g. double sided adhesive tape, double sided foam adhesive tape, adhesive layer with releasable liner, mechanical fasteners, nails, screws, staples, snap fasteners, buttons and other suitable connection means). In a preferred embodiment, the base portion of the electrical candle according to the present invention is connected between a window sash and window sill of the window. Specifically, there exists a connection between the base portion and both the window sill and window sash. Alternatively, the electrical candlestick according to the present invention can be connected directly to the window sash itself (e.g. electrical candlestick device directly connected to lower window sash of double hung window and only making physical contact with window sill when the lower sash is closed).

In any event, in a preferred embodiment, it is desirable to capture the base portion of the electrical candle device according to the present invention between the window sash and window sill. In the most preferred embodiment, there exists no direct connection between the window sash and window sill to avoid the use of adhesives and/or fasteners, but configured to be captured between the movable window sash and stationary window sill. Thus, the most preferred embodiment can be mounted in a window by simply raising or moving the sash of the window from an open position to a closed position to capture the base portion between the closed sash and window sill to securely mount the electrical candle device according to the present invention in the window.

The electrical candle device according to the present invention can be used with various types of windows including double hung type windows having one or more vertically movable sashes, a casement window with a tilt out (e.g. tilt axis horizontally or vertically oriented), a slider having at least one horizontally movable sash, and other types of windows having a movable sash and stationary sill.

The electrical candlestick device according to the present invention can be provided with various types of light emitting devices such as light bulbs, diodes, and other conventional light emitting devices. In a preferred embodiment, the candlestick portion of the device is provided with a standard electrical socket having an internally threaded configuration for receiving a conventional light bulb having a threaded base portion to allow replacement of the light bulb with a new or different type of bulb. For example, conventional holiday or Christmas light bulbs of various standard sizes and sockets are utilized in a preferred embodiment of the electrical candlestick device according to the present invention. The electrical candlestick device according to the present invention can be powered by batteries, solar cells, and/or from a conventional UL outlet, or combinations thereof. In an embodiment utilizing batteries, the batteries can be stored in the candlestick portion and/or base portion of the electrical candlestick device. In embodiments utilizing a solar cell, one or more solar cells located on the candlestick portion, base portion, or located remotely, is connected to batteries located in the candlestick portion and/or base portion so that the device charges during daylight hours and manually or automatically turns on for dusk and night use.

In embodiments utilizing conventional household residential or commercial electric power, the electrical candlestick device includes a power cord connected to the light emitting device at one end and provided with a standard UL electrical plug at an opposite end thereof. In a preferred embodiment of the electrical candlestick device according to the present invention, the power cord extends through the candlestick portion to connect with an electrical socket located in an upper portion of the candlestick portion, and extends down to the base portion of the device. In some embodiments, the power cord exits from the base portion of the device. In other embodiments, the base portion is provided with a mounting extension for connecting with the window sill and/or window sash of the window in combination with a separate power cord associated or not associated with the mounting extension.

In a preferred outdoor application, the power cord is associated with the mounting extension. For example, the power cord can be connected externally and/or provided internally within the mounting extension of the base portion of the device. In one embodiment, the power cord is accommodated within a channel provided within in the mounting extension of the base portion, insert molded within the mounting extension of a plastic base portion, or otherwise incorporated within the mounting extension. Alternatively, one or more electrical conductors (e.g. flat copper, aluminum or other metal strips) are insert molded within the plastic mounting extension of the base portion of the device. In these embodiments, a very low profile can be achieved in the portion of the mounting extension located between the movable sash and stationary sill of the window to allow the sash to be fully closed and properly seal with the window sash while accommodating the electrical candlestick device in this manner. Thus, a seal of the movable sash and/or window sill can sufficiently deform while sealing and allowing the window sash to be closed and preferably locked via a window lock in position.

For indoor applications, a mounting extension of the base portion of the device can be configured to be captured between the movable window sash and stationary sill with a separate power cord exiting from the base portion of the device (i.e. no electrical conductor and/or electrical cord within the mounting extension).

In a preferred embodiment, the electrical candlestick device according to the present invention can include decorative elements and/or features. For example, the candlestick portion and/or base portion of the device can be plastic injection molded having various ornamental designs (e.g. sculptured features, art designs, borders, figurines, engravings, etc.). Alternatively or in addition, add-on items such as wreaths, flowers, ivy, ferns and other decorative accessories can be permanently or releasably connected or mounted on the electrical candlestick device.

DETAILED DESCRIPTION OF PREFERRED EMBODIMENTS

Figure 1:
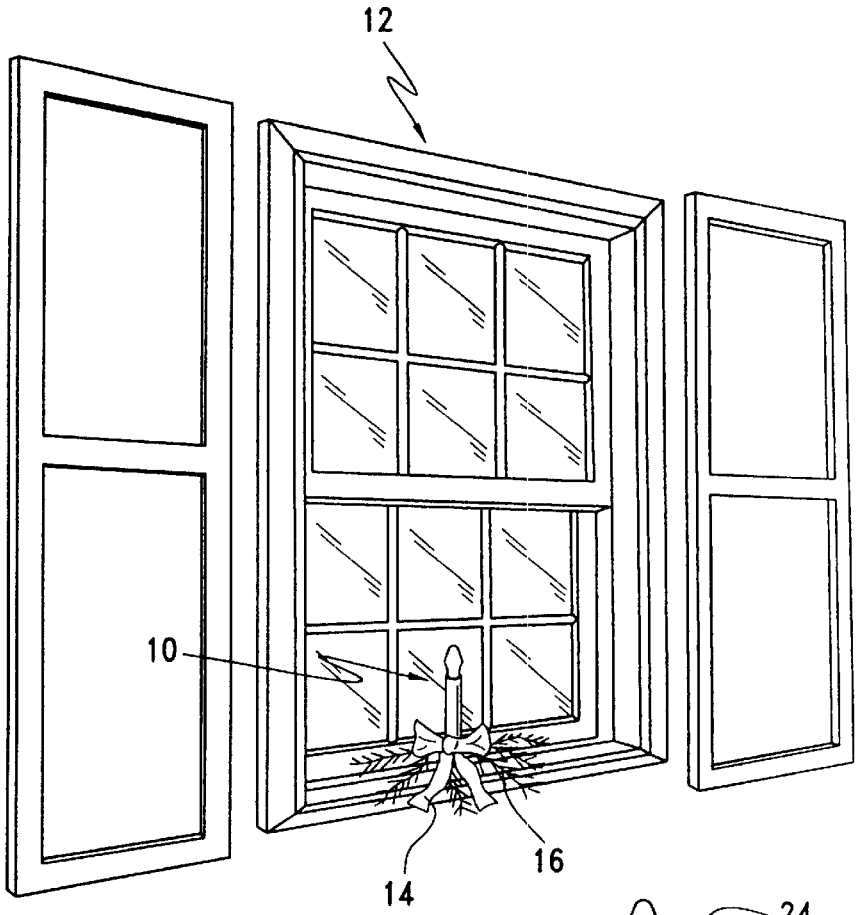
FIG. 1 is a perspective view of an electrical candlestick device according to the present invention mounted in a window.
Figure 2:
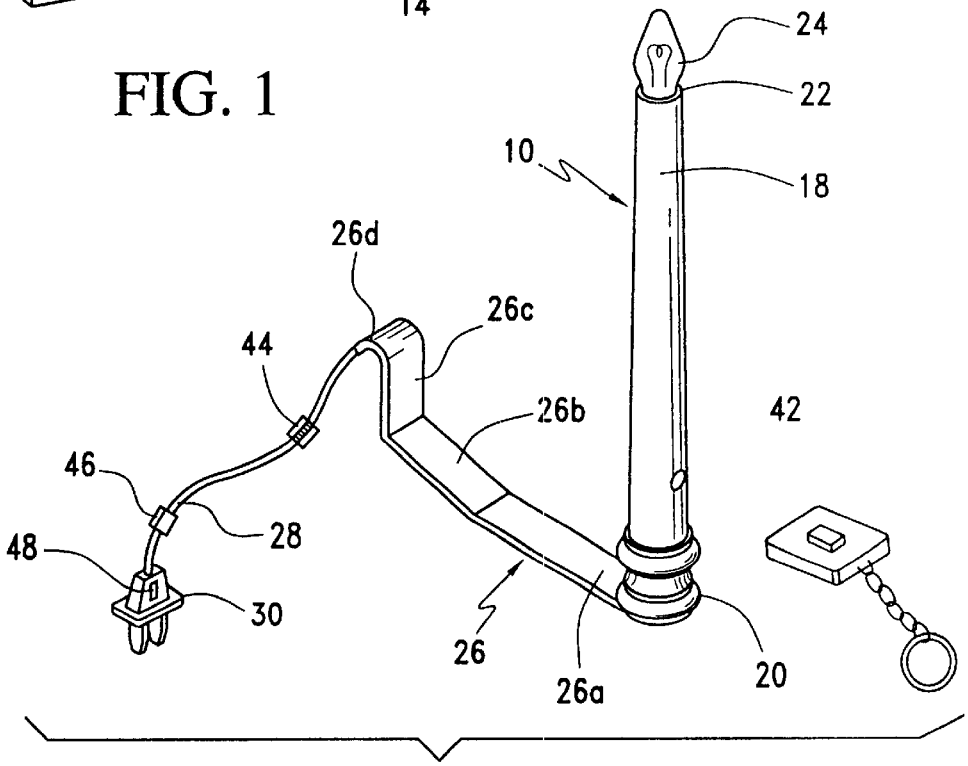
FIG. 2 is a perspective view of an embodiment of the electrical candlestick device according to the present invention.
Figure 3:
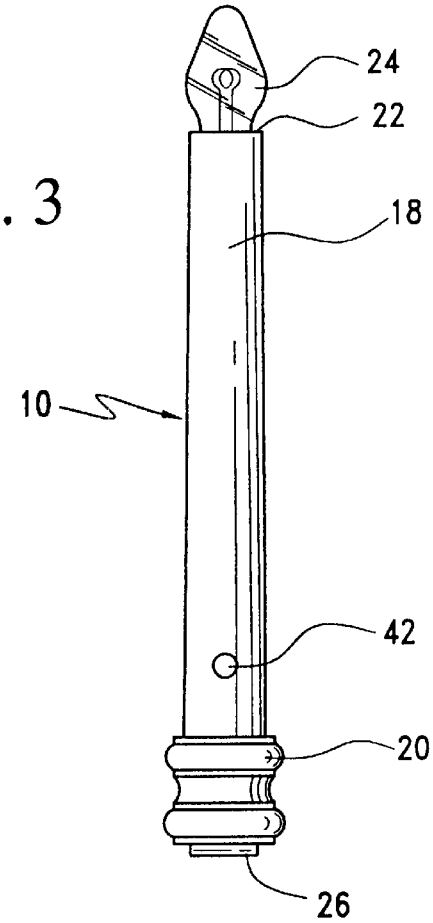
FIG. 3 is a front elevational view of the electrical candlestick device shown in FIG. 2.

An electrical candlestick device 10 according to the present invention is shown mounted in a window 12, as shown in FIG. 1. The electrical candlestick device 10 is provided with a decorative bow 14 and conifer branch cuttings 16.

The electrical candlestick device 10 includes a candlestick portion 18 connected to a base portion 20. An upper portion of the candlestick portion 18 is provided with a lightbulb socket 22 accommodating a replaceable lightbulb 24. Preferably, the lightbulb socket 22 and lightbulb 24 releasably connect by a threaded coupling, however, other types of electrical socket connections can be substituted therefor. Preferably, the candlestick portion 18 and base portion 20 are a single piece plastic injection molded article, however, these components can be separate items assembled together and can be made from material such as plastic, metal, ceramic, composite, and other suitable materials for a particular application.

The electrical candlestick device 10 is provided with a mounting extension 26 including a first portion 26*a*, second portion 26*b* and third portion 26*c*. The electrical candlestick device 10 is provided with a power cord 28 having a standard Underwriters Laboratories plug 30. The plug 30 may be grounded or not grounded depending on particular applications.

Figure 4:
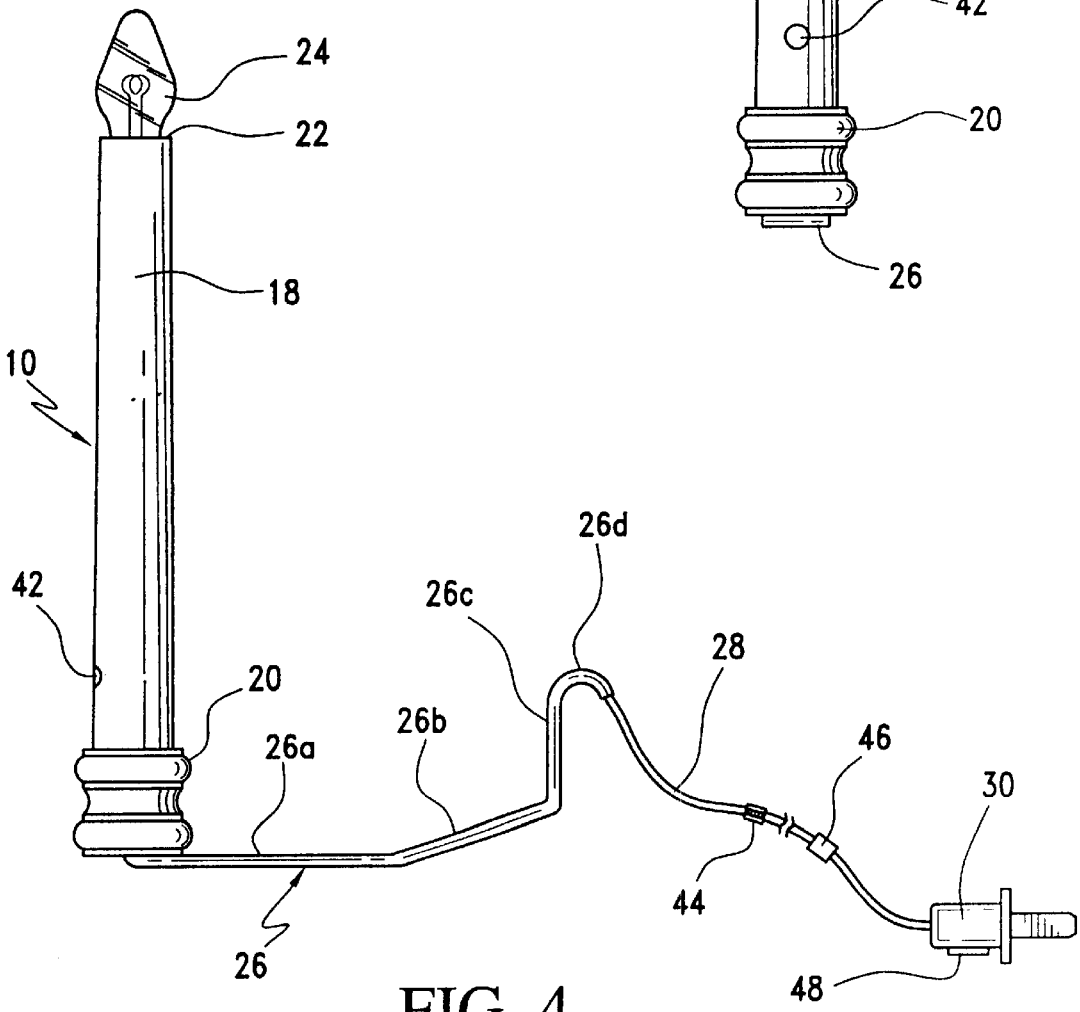
FIG. 4 is a side elevational view of the electrical candlestick device shown in FIGS. 2 and 3.
Figure 5:
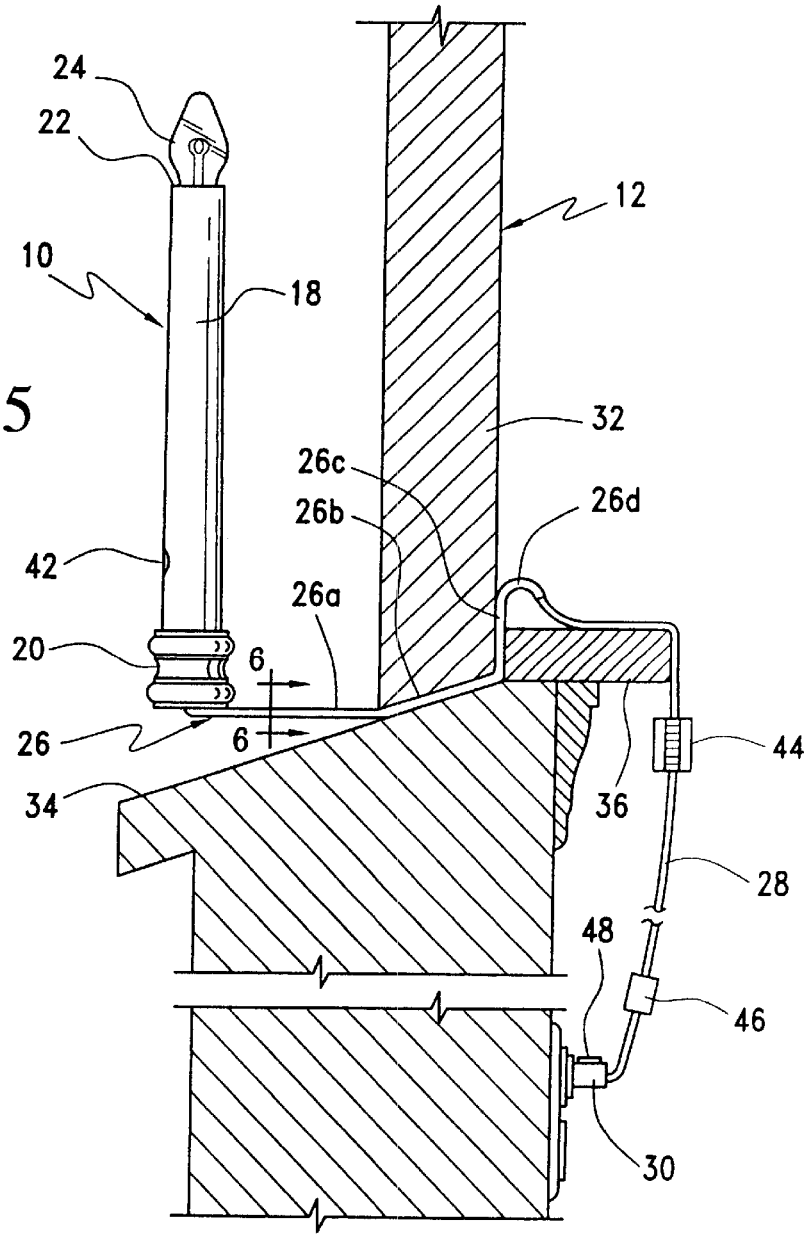
FIG. 5 is a side cross-sectional view showing the electrical candlestick device shown in FIGS. 2–4 mounted in the window shown in FIG. 1.

As shown in FIGS. 4 and 5, the first portion 26*a* of the mounting extension 26 is oriented substantially horizontally. The second portion 26*b* of the mounting extension 26 is inclined at a slight angle relative to the first portion 26*a* to follow the lower edge of the window sash 32 and upper surface of the window sill 34, as shown in FIG. 5. The third portion 26*c* of the mounting extension 26 is oriented substantially vertically to follow the back edge of the window sash 32 and front edge of the interior window sill 36. Further, the third portion 26*c* is provided with a curved or hook portion 26*d* to provide a finger grip to facilitate mounting the electrical candlestick device 10 in the window 12.

Various embodiments of the mounting extension 26 of the electrical candlestick device 10 are shown in FIGS. 6A–6D.

Figure 6A:
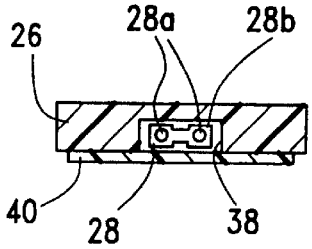
FIG. 6A is a transverse cross-sectional view of the mounting extension indicated in FIG. 5.

The mounting extension 26 shown in FIG. 6A is provided with a channel 38 provided in the bottom of the mounting extension 28. The channel 38 can be formed by injection molding a plastic mounting extension 26 or can be formed by various operations including machining (e.g. milling). The power cord 28 having a pair of electrical conductors 28*a* surrounded by an insulation layer 28*b* is accommodated within the channel 38 of the mounting extension 26. A protective layer 40 secures the power cord 28 within the channel 38. For example, the protective layer 40 can be tape (e.g. mylar tape), foam tape, double-sided adhesive tape, double-sided foam tape or other suitable material for securing the power cord 28 within the channel 38 and optionally provide mounting means (e.g. adhesive means) for mounting the electrical candlestick device 10 within the window.

Figure 6B:
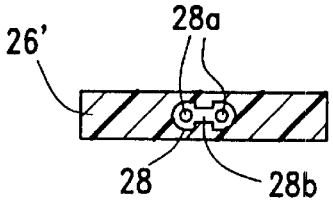
FIG. 6B is a transverse cross-sectional view of another embodiment of the mounting extension as indicated in FIG. 5.

In the embodiment of the mounting extension 26' shown in FIG. 6B, the power cord 28 is insert molded within the plastic mounting extension 26' during injection molding of the mounting extension 26'.

Figure 6C:
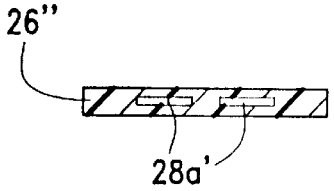
FIG. 6C is a transverse cross-sectional view of a further embodiment of the mounting section as indicated in FIG. 5.

In the embodiment of the mounting extension 26" shown in FIG. 6C, a pair of flat conductors 28'(e.g. made of flat copper or aluminum) are insert molded when the mounting extension 26" is injection molded. This arrangement provides a very low profile (e.g. cross-sectional height) of the mounting extension 26" to allow the window sash 32 to be fully closed on the window sill 34 as shown in FIG. 5. In this embodiment, no additional or separate layer of insulation is provided around the flat conductors 28*a*', since the plastic material is selected to provide the proper insulated value for the mounting extension 26".

Figure 6D:
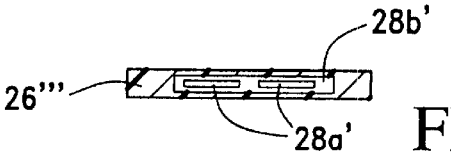
FIG. 6D is a transverse cross-sectional view of an even further embodiment of the mounting extension as indicated in FIG. 5.
Figure 7:
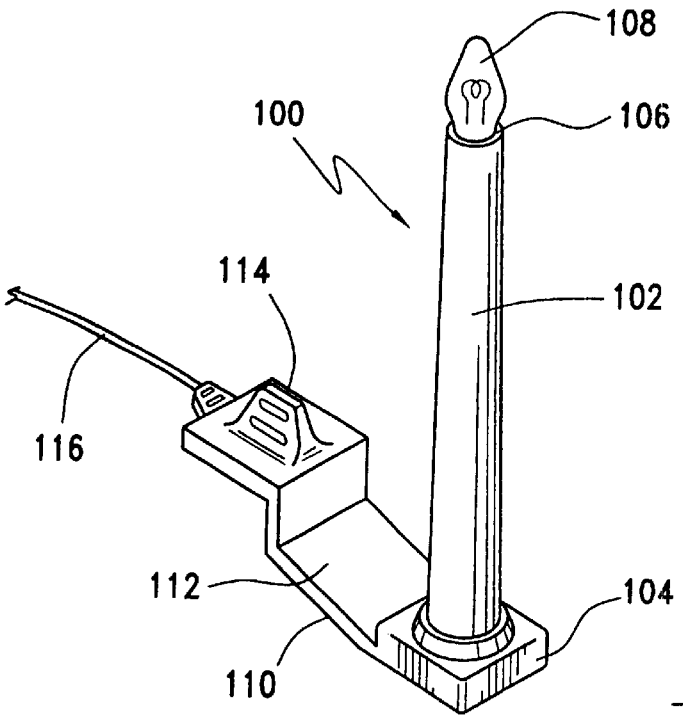
FIG. 7 is a perspective of another embodiment of the electrical candlestick device according to the present invention.

In the embodiment of the mounting extension 26'" shown in FIG. 6D, a pair of flat conductors 28*a*' are insulated in a separate layer of insulation 28*b*' to provide an additional layer of insulation.

The electrical candlestick device 10 can be provided with the following optional features. An electric eye 42 can be provided (e.g. in candlestick portion 18) to automatically turn on or off the electrical candlestick device 10 based on ambient lighting levels. A thumb switch 44 can be provided in power cord 28 to manually turn on or off the electrical candlestick device 10. An electrical timer 46 (e.g. on power cord 28) can be provided for automatically turning on or off the electrical candlestick device 10 base on preset times or preprogrammed time periods. A fuse 48 (e.g. on plug 30) can be provided to protect against power shorts and/or power spikes. Further, the electrical candlestick device 10 may include a remote control 48 (e.g. key chain type pog) and internal circuitry to provide on/off remote operation thereof.

Another embodiment of an electrical candlestick device 100 is shown in FIGS. 7–11.

The electrical candlestick device 100 includes a candlestick portion 102 connected to a base portion 104. The electrical candlestick device 100 includes an electrical socket 106 for accommodating a replaceable lightbulb 108.

The base portion 104 is provided with a mounting extension 110 including a channel portion 112 and a finger grip portion 114. A power cord 116 extends from the mounting extension 110 and connects to a standard UL plug (not shown). Preferably, the electrical candlestick device 100 is a single piece injection molded plastic article having a metal electrical socket provided in an upper end of the candlestick portion 102 with the power cord 116 extending through the mounting extension 11O through the base portion 104 and up through the candlestick portion 102 to the electrical socket 106.

Figure 11:
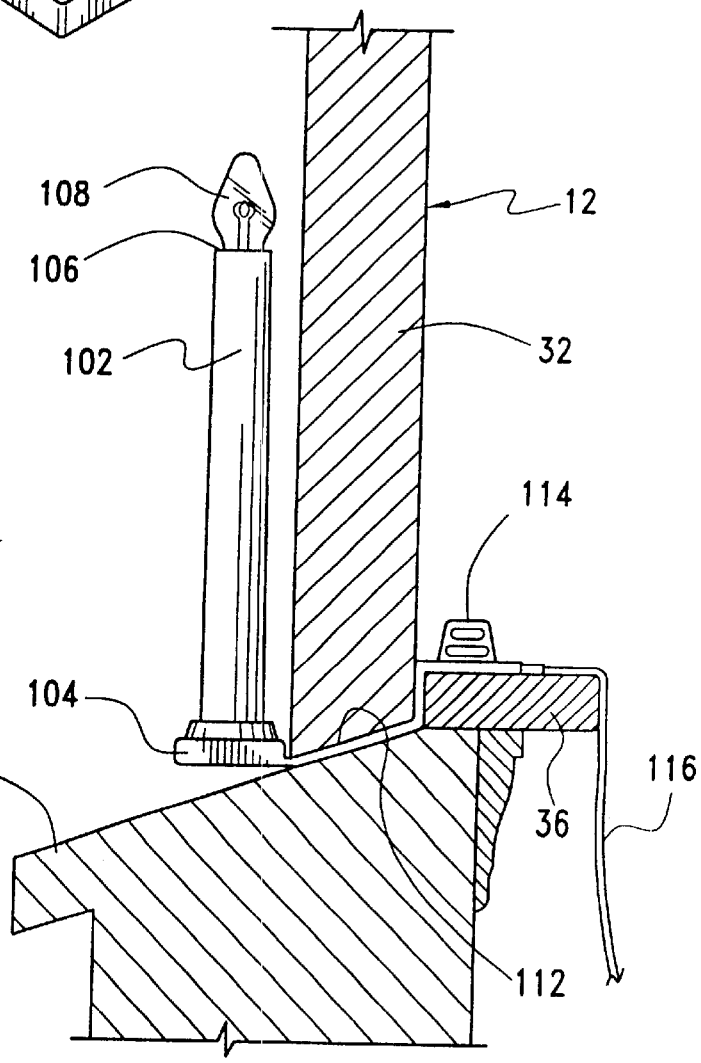
FIG. 11 is a side cross-sectional view of another embodiment of the electrical candlestick device shown in FIGS. 7–10 mounted in a window.
Figure 8:
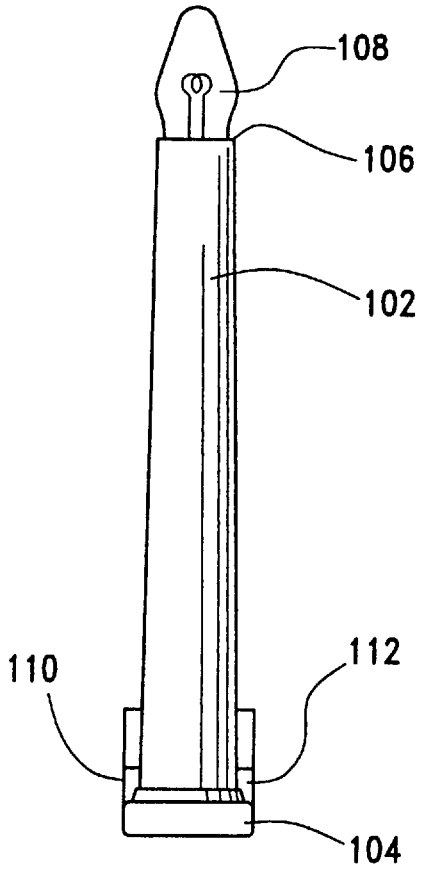
FIG. 8 is a front elevational view of the embodiment of the electrical candlestick device shown in FIG. 7.
Figure 9:
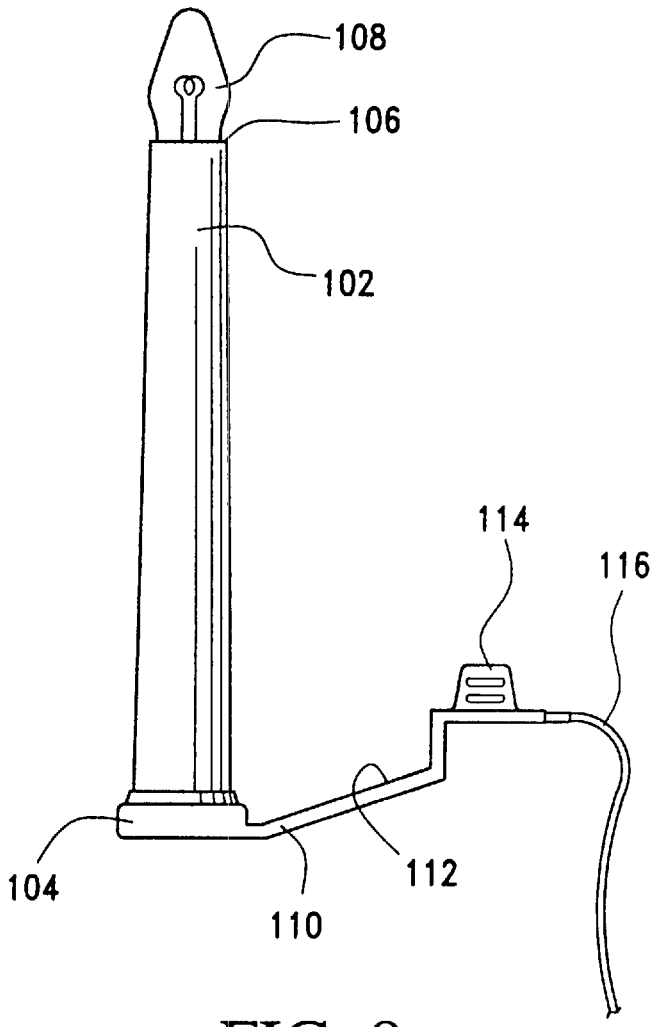
FIG. 9 is a side elevational view of another embodiment of the electrical candlestick device shown in FIGS. 7 and 8.
Figure 10:
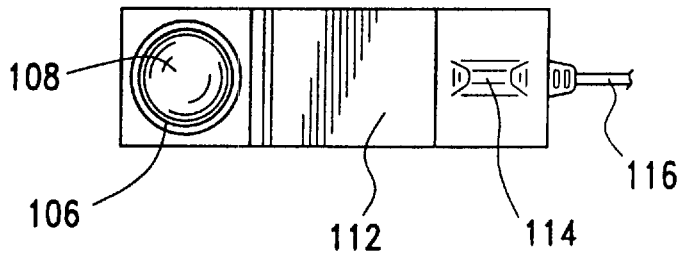
FIG. 10 is a top elevational view of another embodiment of the electrical candlestick device shown in FIGS. 7–9.

In one embodiment, the width of the channel portion 112 is slightly greater than the width of the lower window sash 32, as shown in FIG. 11. Alternatively, the width of the channel portion 112 is selected to be slightly less than the width of the lower window sash 32 so that the device 100 directly connects (by interference fit) with the window sash 32 and can be lowered and raised with the window sash 32.

Figure 12:
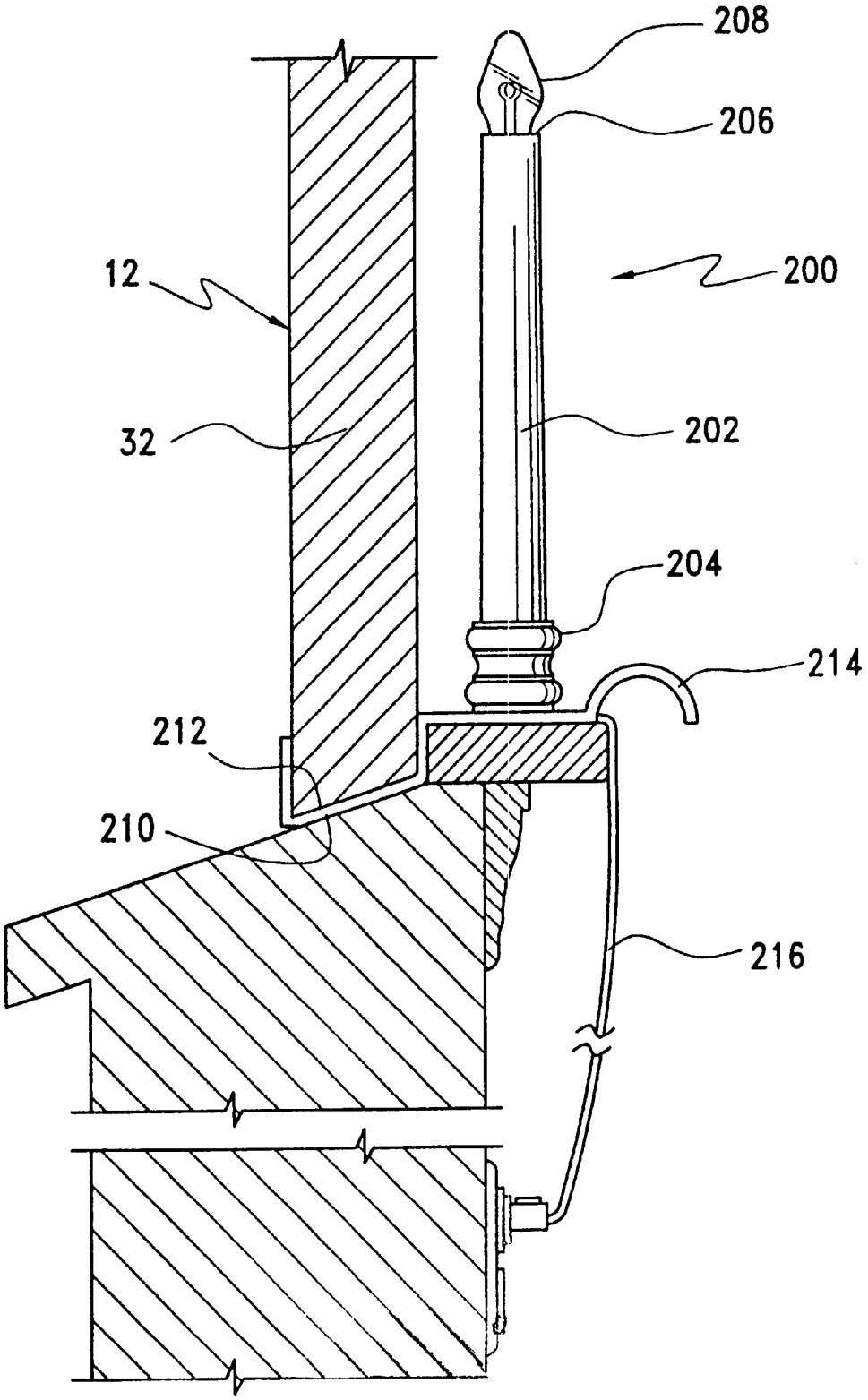
FIG. 12 is a side cross-sectional view of a further embodiment of the electrical candlestick device according to the present invention mounted in a window.

The two (2) embodiments shown in FIGS. 1–11 are configured and or arranged for outdoor applications. Specifically, in these two embodiments, the electrical candlestick device 10 and 100 are both located exterior relative to the window 12. A further embodiment of the electrical candlestick device 200 for indoor applications is shown in FIG. 12.

The electrical candlestick device 200 includes a candlestick portion 202 and base portion 204. An upper portion of the candlestick portion 202 is provided with an electrical socket 206 for accommodating a replaceable lightbulb 208. The base portion 204 is provided with a mounting extension 210 having a candle portion 212 at one side of the base portion 204 and an upside down loop portion 214 at an opposite side of the base portion 204 to provide a finger grip to facilitate mounting the electrical candlestick device 200 in the window 12. A power cord 216 extends from the mounting extension 210, however, the power cord 216 alternatively can exit from the base portion 204.

MOUNTING/OPERATION

The electrical candlestick device according to the present invention is configured to be mounted on the sill of a window. Preferably, the electrical candlestick device according to the present invention is configured so that no additional fasteners such as nails, staples, tacks, other mechanical fasteners, tape, adhesive layers are required. However, these types of additional fasteners can be combined with the electrical candlestick device according to the present invention to increase the mounting strength between the device and the window sill or potentially to make mounting installation easier. These additional fasteners however, will require additional cost and possible inconveniences such as requiring additional time for mounting or dismounting the electrical candlestick device from the window, or require cleanup after removal of the electrical candlestick device.

In the embodiment shown in FIGS. 1–5, the window sash 32 is opened and a person standing on the interior of the window 12 grips the gripping portion 26*d* between their index finger underneath and thumb over the top of this portion 26*d*. The person moves the electrical candlestick device 10 to the center of the window and then lowers the same so that the incline portion 26*b* of the mounting extension 26 makes contact with the upper surface of the window sill 34. The person then pulls the electrical candlestick device 10 backwards until the portion 26*c* of the mounting extension 26 makes contact with the front surface of the interior window sill 36 as shown in FIG. 5. Then, the person lowers the window sash 32 into contact with the incline portion of the mounting extension 26*b* and then locks the window sash 32 to securely mount the electrical candlestick device 10 within the window 12. To remove the electrical candlestick device 10, the window sash 32 is simply unlocked and lifted while the person grips the gripping portion 26*d* and then removes the unit. The electrical candlestick device 10 must be plugged in for installation and operation and unplugged for removal of the electrical candlestick device 10.

In the embodiments shown in FIGS. 7–11, the same steps for mounting and removal of the electrical candlestick device 100 apply for the embodiments shown in FIGS. 1–6. However, the person grips the finger grip 114 between their thumb and forefinger for holding the electrical candlestick device 100 during installation or removal of the electrical candlestick device 100.

In the embodiment shown in FIG. 12, the same procedure is utilized in the two embodiments shown in FIGS. 1–11, however, a person grips the gripping portion 214 with the index finger underneath and thumb over while the candlestick portion 202 and base portion 204 remain interior of the window 12. In the second embodiment shown in FIGS. 7–11 and third embodiment shown in FIG. 12, the window sash 32 is lowered into the channel portion 112 and 212, respectively, to securely mount the electrical candlestick devices 100 and 200 in the window 12. The channel type configuration of the second and third embodiment versus the non-channel embodiment shown in FIGS. 1–6 provide additional mounting, stability and strength.

What is claimed is:

1. An electrical candle device configured for a window having a movable sash and stationary sill, said device comprising:

a candlestick portion;

an electrical light emitting device provided at an upper end of said candlestick portion;

a base portion provided at a lower end of said candlestick portion, said base portion including a mounting extension configured to connect between the movable sash and stationary sill of the window to position and mount said candlestick portion in a substantially upright position adjacent the window; and an electrical conductor associated with said candlestick device, said electrical conductor electrically connected to said electrical light emitting device and configured for connecting with a power source, said electrical conductor extending through at least a portion of said mounting extension.

2. A device according to claim 1, wherein said extension is configured to fit between the movable sash and stationary sill of the window when the window is in a closed position.

3. A device according to claim 2, wherein said electrical conductor extends through at least a portion of said mounting extension.

4. A device according to claim 1, wherein said electrical conductor extends through a portion of said mounting extension located between the window sash and sill.

5. A device according to claim 4, wherein said electrical conductor is a wire conductor.

6. A device according to claim 4, wherein said electrical conductor is a flattened wire conductor.

7. A device according to claim 4, wherein said extension is provided with a channel for accommodating said electrical conductor.

8. A device according to claim 4, wherein said electrical conductor is molded within said extension.

9. A device according to claim 1, wherein said mounting extension is provided with a finger grip portion to facilitate mounting said device within the window.

10. A device according to claim 9, wherein said finger grip portion is defined by an upside down U-shaped portion provided at an end of said mounting extension.

11. A device according to claim 9, wherein said finger grip portion is defined by an upwardly extending protrusion provided on said mounting extension.

12. A device according to claim 1, wherein said mounting extension is provided with a substantially horizontally oriented first extension portion extending to an inclined second extension portion extending to a substantially vertically oriented third extending portion.

13. A device according to claim 12, including an upside down U-shape end extending from said third extending portion to provide a finger grip portion.

14. A device according to claim 12, wherein said inclined second extension portion is set an angle relative to said first extension portion to be substantially parallel with an inclined sill portion of the stationary window sill.

15. A device according to claim 1, including a power source.

16. A device according to claim 15, wherein said power source is a battery.

17. A device according to claim 16, including a solar cell for recharging said battery.

18. A device according to claim 1, wherein said electrical conductor is provided with a UL type plug electrical connector.

19. A device according to claim 1, including an electrical socket provided in an upper end of said candle stick housing for accommodating a replaceable light bulb.

* * * * *